US006604570B1

(12) United States Patent
Suk et al.

(10) Patent No.: US 6,604,570 B1
(45) Date of Patent: Aug. 12, 2003

(54) APPARATUS AND METHOD FOR MANUFACTURING METAL FILAMENTS

(75) Inventors: Chang-Hwan Suk, Seoul (KR); Deck-Yui Lee, Kyonggi (KR); Man-Ho Park, Seoul (KR)

(73) Assignee: Fiber Tech Co., Ltd., Kyonggi (KR)

( * ) Notice: Subject to any disclaimer, the term of this patent is extended or adjusted under 35 U.S.C. 154(b) by 0 days.

(21) Appl. No.: 10/142,714

(22) Filed: May 10, 2002

(51) Int. Cl.[7] ..... B22D 11/06; B22D 27/02; B22D 27/04

(52) U.S. Cl. ..... 164/463; 164/423; 164/471; 164/513

(58) Field of Search ..... 164/463, 423, 164/471, 513

(56) References Cited

U.S. PATENT DOCUMENTS

| | | | | |
|---|---|---|---|---|
| 3,812,901 | A | 5/1974 | Stewart et al. | |
| 4,157,729 | A | 6/1979 | Patton et al. | |
| 4,290,993 | A | 9/1981 | Maringer | 264/164 |
| 4,339,508 | A | 7/1982 | Tsuya et al. | 428/606 |
| 4,807,694 | A | 2/1989 | Vives et al. | 164/466 |
| 4,930,565 | A | 6/1990 | Hackman et al. | 164/463 |
| 4,946,746 | A | 8/1990 | Ichiryu et al. | 428/606 |
| 5,015,993 | A | 5/1991 | Strom-Olsen et al. | 340/551 |
| 5,027,886 | A | 7/1991 | Strom-Olsen et al. | 164/463 |
| 5,213,151 | A | 5/1993 | Hackman | 164/453 |
| 5,345,993 | A | 9/1994 | Hackman | 164/423 |
| 5,601,139 | A | 2/1997 | Remy | 164/463 |
| 5,642,771 | A | 7/1997 | Forest | 164/463 |

FOREIGN PATENT DOCUMENTS

| | | | |
|---|---|---|---|
| KR | 178643 | 9/1998 | D01F/9/08 |
| KR | 190906 | 9/1998 | D01F/9/08 |

*Primary Examiner*—Kuang Y. Lin
(74) *Attorney, Agent, or Firm*—Abelman, Frayne & Schwab

(57) ABSTRACT

An apparatus and method for continuously manufacturing metal filaments in mass production. In accordance with the present invention, molten metal is hung in a state freely depending from the tip of a metal bar by its surface tension without using any vessel. The metal filament manufacturing apparatus includes an induction coil upwardly bent in the form of a nose shape at regions thereof where metal filaments are discharged while being soared up, respectively, so as to prevent the molten metal of each of the metal bars from being affected by the induction coil during soaring of the metal filaments. The apparatus also includes wiping assembly for removing residual metal materials left on a spinning disk.

6 Claims, 5 Drawing Sheets

FIGURE

APPARATUS AND METHOD FOR MANUFACTURING METAL FILAMENTS

BACKGROUND OF THE INVENTION

1. Field of the Invention

The present invention relates to an apparatus and method for manufacturing metal filaments, and more particularly to an apparatus and method for manufacturing fine metal filaments from metal bars using a rapid solidification process.

2. Description of the Related Art

Here, "metal filament" is a fiber having a circular or nearly circular cross section with a diameter of 100 μm or less.

In order to manufacture such a metal fiber, various methods have been used. For example, there are a method for drawing a metal material having a bar or rod shape using a die made of a hard alloy or diamond, a method for cutting a solid metal material to obtain a wire, and a method for extracting molten metal using a nozzle having a small diameter, and solidifying the extracted product. A metal fiber manufacturing method using a rapid solidification process has been used since 1980, taking into consideration the advantages of that process capable of simplifying the manufacturing apparatus while providing a uniformity of fibers. Products obtained in accordance with such a rapid solidification process may have forms of fibers, strips, and ribbons.

For example, U.S. Pat. Nos. 4,290,993, 3,812,901, and 5,015,993 disclose methods for manufacturing filaments by bringing a rotating disk having an indented wheel shape into contact with a molten metal material contained in a vessel such as a hearth or crucible. Similar methods are also disclosed in U.S. Pat. Nos. 5,642,771, 5,601,139, and 4,339,508. That is, they disclose methods for manufacturing metal strips or metal ribbons having a cross section with a rectangular or plate shape, rather than a circular or nearly circular shape, by supplying a molten metal material onto a cooling surface having at least one groove with a certain depth using a nozzle or tube, solidifying the supplied molten metal material while allowing the material to flow, along the groove, toward a disk arranged beneath the cooling surface. In addition, U.S. Pat. Nos. 5,213,151, 4,930,565, 5,345,993, and 4,807,694 disclose methods for manufacturing metal strips using a rotating disk under the condition in which a molten metal material is contained in a vessel such as a hearth or crucible.

However, the above mentioned methods, in which metal fibers are manufactured using a molten metal contained in a vessel have problems of damage of the vessel by heat and a change in composition caused by a reaction of the molten metal with the vessel, because the vessel should receive the molten metal maintained at a high temperature of 1,600° C. For this reason, it is impossible to continuously supply molten metal contacting the rotating disk. Furthermore, where molten metal is extracted using a nozzle or tube, it is impossible to manufacture fine products such as fibers. Typically, products having a strip or ribbon shape with a certain width are manufactured by this method.

U.S. Pat. No. 4,946,746 discloses an advanced technique. That is, this patent discloses an apparatus and method for manufacturing metal fibers by injecting a molten metal material into the interior of a rotating drum by use of a nozzle, and solidifying the injected metal material. However, this technique has problems in that when the amount of molten metal to be injected is increased, the amount of the molten metal collect in an entrance of nozzle without being injected is increased, thereby causing a degradation in workability and productivity. Since the molten metal should be injected through the nozzle, it is impossible to obtain metal fibers having a diameter of 70 μm or less.

In order to eliminate drawbacks involved with the methods in which metal fibers are manufactured using a molten metal material contained in a vessel, U.S. Pat. No. 5,027,886 discloses a method for fabrication of metallic fibers by upwardly supplying a metal rod through a vertical opening, and heating to the upper end of the metal rod. In accordance with this method, a metal rod is supplied through a guide. The upper end of the metal rod is melted by an induction coil installed around the upper end of the guide. The molten metal is stored in a collar at the upper end of the guide so that it subsequently comes into contact with a spinning wheel, so as to continuously manufacture metal fibers. However, the supplied metal rod may abrade the guide and collar as it comes into frictional contact with such guide and collar. As a result, a gap may be formed between the collar and the metal rod. In this case, there are problems associated with process continuity and stability because molten metal may flow through the gap. Furthermore, although the collar and guide temporarily support the molten metal, they still have problems associated with damage thereto by the heat of the molten metal. Where an induction coil having a bowl shape is used, the extracted metal fibers may be stained on the coil. Where an induction coil having a flat plate shape is used, an increased coil installation space of 7 to 8 cm on the average per rod having 1 cm in diameter is required. For this reason, it is impossible to install a sufficient number of rods in one manufacturing apparatus. Thus, it is impossible to provide a manufacturing apparatus with a high productivity.

U.S. Pat. No. 4,157,729 and Korean Patent Nos. 178643 and 190906 registered in the name of the inventors disclose methods and devices for manufacturing metal filaments by heating the entire of a metal rod by a first heating member while heating an end of the metal rod by a second heating member, thereby forming droplets of the melt and forming metal filaments from those droplets using a rotating disk. Since the first heating member is arranged within the second heating member, induced current is generated at the first heating member during a secondary heating process, thereby causing an electrical short circuit or spark. In this case, the manufacturing process cannot be further performed.

When liquid metal of high temperature is rapidly solidified, it may be left on a rotating disk due to its residual stress and chemical affinity without being released from the rotating disk. When such a residual material subsequently comes into contact with molten metal, it destroys the stability of the liquid metal and the process must be stopped. In order to solve this problem, U.S. Pat. No. 5,601,139 proposed use of a cleaning device. However, a wire blush type of cleaning device may damage the surface of the disk when it is used for a prolonged period of time. For this reason, it may be difficult to continuously manufacture fibers of a desired small diameter and the surface of disk blade becomes harsh. In addition, diameter of fiber isn't uniform.

SUMMARY OF THE INVENTION

Therefore, an object of the invention is to provide an apparatus and method for continuously manufacturing metal filaments in mass production by melting only the end of a metal bar in accordance with a high frequency induction heating process in a vacuum device, thereby forming a molten metal maintained, without using any vessel such as crucible, hearth in a state freely depending from the end of the metal bar in accordance with the balance between the weight of the molten metal and the surface tension of the molten metal, and bringing the molten metal into contact with a spinning disk, thereby solidifying the molten metal in the form of fibers having an ingredient uniformity.

In accordance with one aspect, the present invention provides an apparatus for manufacturing metal filaments comprising: metal bar supply assembly including a support member adapted to support a plurality of metal bars, a screw adapted to rotate for a vertical movement thereof by a servo-motor, and a guide rod adapted to guide the screw to carry out an accurate vertical movement, the metal bar support member connecting the metal bars, the screw, and the guide rod, and vertically feeding the metal bars at a speed of 0.1 to 100 mm/min, the metal bar supply assembly being configured to individually control the metal bars; metal bar heating assembly including an induction coil arranged near lower ends of the metal bars, and adapted to a limited part to melt the tip of the metal bars in accordance with a heating operation thereof, a coil block adapted to supply high frequency induction current to heat each of the metal bars to a melting temperature, and a coil cooling water supplier adapted to prevent the induction coil from being melted, the induction coil being upwardly bent in the form of a nose shape at regions thereof where metal filaments are discharged while being soared up, respectively, so as to prevent each molten metal of the metal bars from being affected by the induction coil during soaring of the metal filaments; cooling assembly including a spinning disk provided at a peripheral surface thereof with a plurality of disk blades each having a sharp edge, the spinning disk serving to quench the molten metal at a rate of $10^4$ to $10^{6°}$ C./sec while rotating at a linear speed of 1 to 100 m/sec, thereby soaring a metal filament; and wiping assembly including a heat-resistant non-woven fabric adapted to come into direct contact with the spinning disk, thereby removing residual metal materials left on the spinning disk without being released from the spinning disk during the soaring of the metal filaments, and a rotating drum adapted to support the non-woven fabric while enabling a continuous cleaning operation and reducing generation of friction; wherein the metal bar heating assembly, the cooling assembly, and the wiping assembly are arranged in the interior of a vacuum chamber, the molten metal is maintained in the form of a droplet depending from its metal bar by its surface tension without using any particular vessel such as a crucible, hearth, and the soared up metal filaments have a diameter of 10 to 150 $\mu$m.

In accordance with another aspect, the present invention provides a method for manufacturing metal filaments comprising the steps of: preparing a metal filament manufacturing apparatus including metal bar supply assembly for supporting a plurality of metal bars, and vertically feeding the metal bars, metal bar heating assembly including an induction coil, a coil block, and a coil cooling water supplier, cooling assembly including a spinning disk provided at a peripheral surface thereof with a plurality of disk blades each having a sharp edge, and wiping assembly including a heat-resistant non-woven fabric, and a rotating drum; forming a vacuum in a chamber in which the metal bar heating assembly, the cooling assembly, the wiping assembly are arranged; supplying a plurality of metal bars at a speed of 0.1 to 100 mm/min by the metal bar supply assembly, thereby arranging the end of each of the metal bars near the induction coil of the metal bar heating assembly, applying electric power to the induction coil, thereby heating and melting a tip of the metal bar, so that molten metal is freely hung at the end of the metal bar in the form of a droplet maintained in a state depending from the end of the metal bar without using any vessel; bring the molten metal into contact with an associated one of the disk blades of the spinning disk rotating at a linear speed of 1 to 100 m/sec, thereby a metal filament having a diameter of 10 to 150 $\mu$m while quenching the molten metal at a rate of $10^4$ to $10^{6°}$ C./sec; and bring the disk blades of the spinning disk brought into contact with the non-woven fabric attached to the rotating drum of the wiping assembly, thereby removing residual materials or foreign matters firmly attached to the disk blade.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, the present invention will be described in detail with reference to the annexed drawings.

Figure 1:
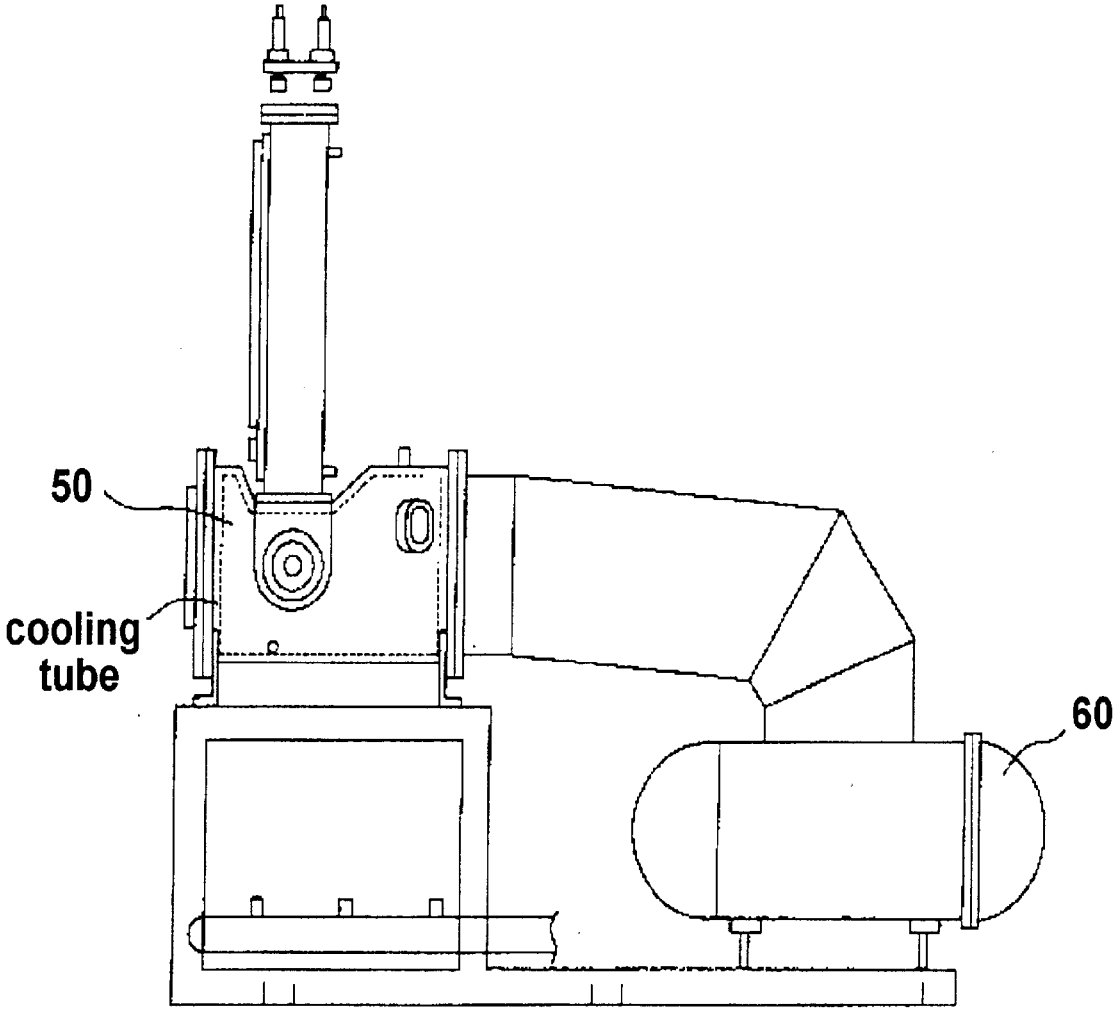
FIG. 1 is a view illustrating the entire outer configuration of a metal filament manufacturing apparatus according to the present invention.
Figure 2:
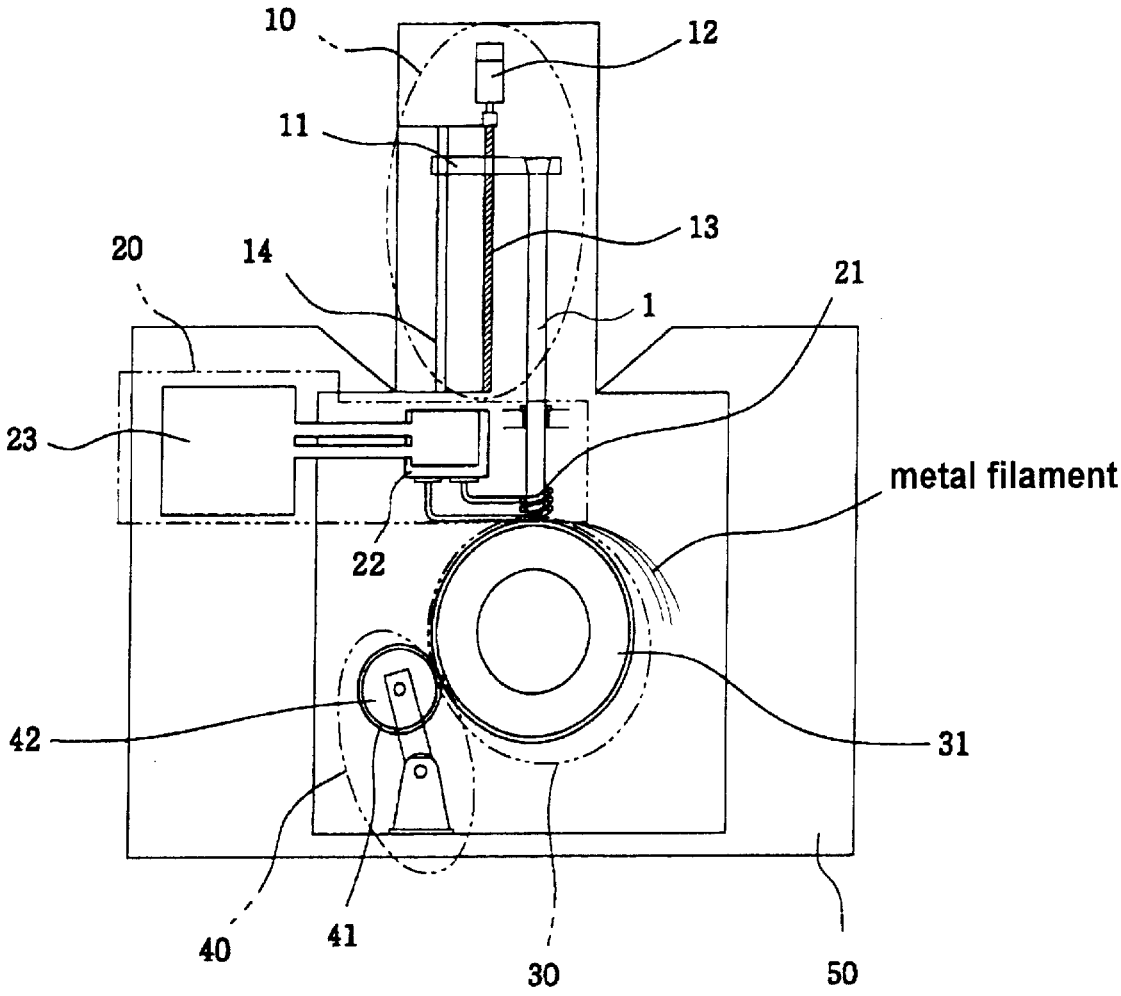
FIG. 2 is a schematic sectional view illustrating an essential part of the metal filament manufacturing apparatus according to the present invention.

FIG. 1 is a view illustrating the entire outer configuration of a metal filament manufacturing apparatus according to the present invention. FIG. 2 is a schematic sectional view illustrating an essential part of the metal filament manufacturing apparatus according to the present invention.

Referring to FIG. 1, the metal filament manufacturing apparatus according to the present invention mainly includes a metal bar supply assembly for supplying a plurality of metal bars to be used as a raw material for manufacturing metal filaments, a chamber 50 for obtaining metal filaments from the supplied metal bars, and spinning the metal filaments, and a bucket 60 for collecting the soaring metal filaments. The features of the present invention are associated with the metal bar supply assembly and chamber 50. Accordingly, the configurations of the metal bar supply assembly and chamber 50 are more concretely illustrated in FIG. 2.

Referring to FIG. 2, a metal bar supply assembly 10 is illustrated. As shown in FIG. 2, the metal bar supply assembly 10 includes a support member 11 adapted to support a plurality of metal bars 1, a screw 13 adapted to rotate at a micro speed of 0.1 to 100 mm/min by a servo-motor 12, and a guide rod 14 arranged at the rear of the screw, and adapted to guide the screw 13 to perform an accurate vertical movement.

The metal bar support member 11 directly connects the metal bars 1, screw 13, and guide rod 14, and moves vertically along the screw 13 rotating in accordance with an operation of the servo-motor 12, thereby vertically feeding the metal bars 1. The portions of the support member 11, to which respective metal bars 1 are connected, have a tapered shape, in order to achieve easy connection and disconnection of the metal bars 1 without using any separate support mechanism. Since the supply speed of the metal bars 1 can be controlled to be within a range of 0.1 to 100 mm/min by the servo-motor 12 of the metal bar supply assembly 10, it is possible to achieve a regular and continuous supply of metal bars. By the guide rod 14, an accurate vertical movement of each metal bar can be achieved.

Each metal bar 1 is supplied into the chamber 50 where a metal filament manufacturing process is carried out. A metal bar heating assembly 20, a cooling assembly 30, and a wiping assembly 40 are arranged in the chamber 50. In order to avoid a degradation in the process continuity and a degradation in the purity of products, all processes are carried out under a high vacuum condition. In accordance with the present invention, the chamber 50 is in a vacuum of $10^{-1}$ to $10^{-7}$ torr.

Figure 3:
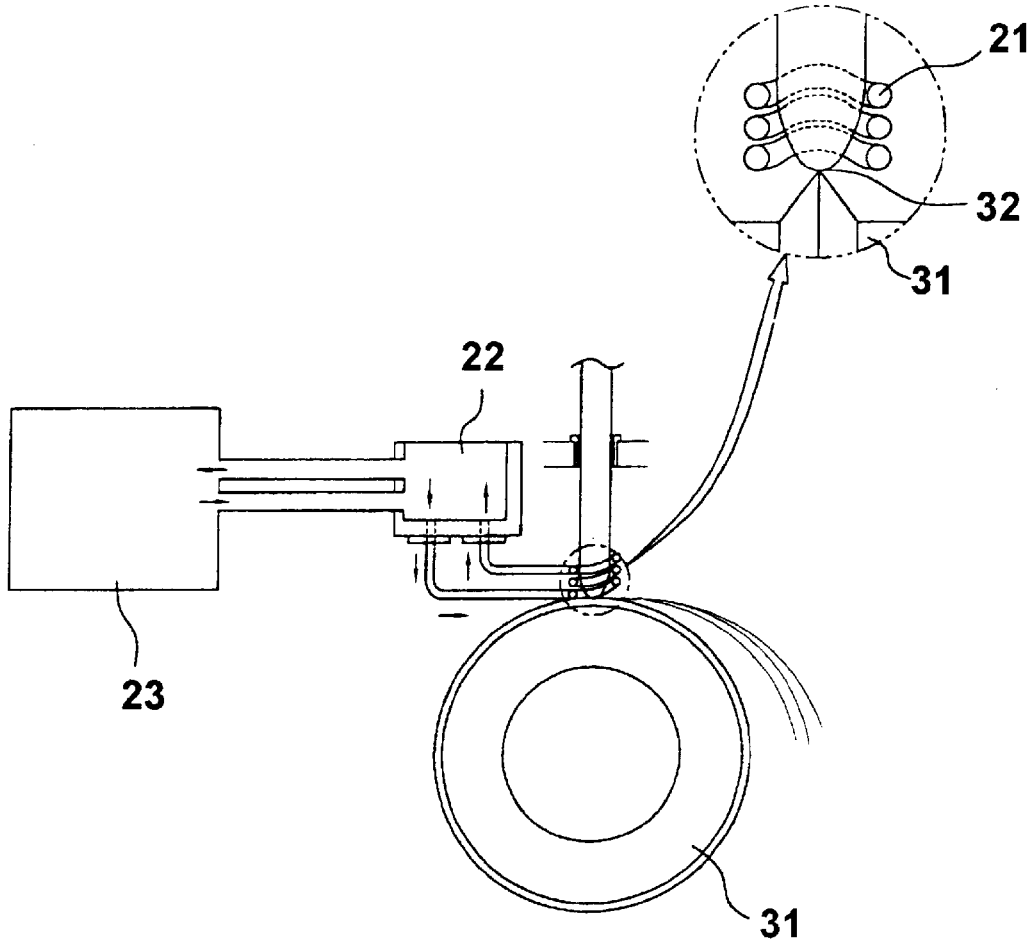
FIG. 3 includes a side view illustrating a metal bar heating assembly according to the present invention in a separated state, and an enlarged front view illustrating a part of the heating assembly.

FIG. 3 is a partially-enlarged front view of the metal bar heating assembly 20 in a separated state, along with an induction coil, viewed in a soaring direction of metal filaments.

The metal bar heating assembly 20 includes an induction coil 21 arranged near lower end of the metal bars 1, and adapted to a limited part to melt tip of each metal bar 1 in accordance with a heating operation thereof, a coil block 22 adapted to supply high frequency induction current to heat each metal bar 1 to a melting temperature while controlling supply of power, and a coil cooling water supplier 23 adapted to prevent the induction coil 21 from being melted by heat emitted from the melted metal.

FIG. 3 illustrates an enlarged view of the induction coil 21. As shown in FIG. 3, the induction coil 21 extends spirally in a vertical direction so that it has a plurality of coil layers in order to effectively surround each metal bar 1. Metal filaments may come into contact with the induction coil 21 when they are solidified while being soaring as molten metal comes into contact with a spinning disk, as described hereinafter. As a result, metal filaments may be undesirably stuck on the spinning disk. In order to prevent such a phenomenon, the induction coil 21 is upwardly bent in the form of a nose shape at regions thereof where the soaring metal filaments are discharged, respectively. Since the heating process is carried out using the induction coil of the present invention which does not exhibit any reaction even when it comes into contact with a high-temperature melt of metal such as an iron alloy, it is possible to maintain a desired process continuity while performing a local heating process for micro areas without any damage to the metal to be heated, and without any preheating time. Accordingly, an improvement in workability and productivity is achieved.

Each metal bar is heated a limited part to a temperature of 1,500 to 1,700° C. by the induction coil 21, so that only its tip is melted. The molten metal is maintained in a state freely depending from the tip of the metal bar in the form of a droplet, without using any vessel such as a storage used for conventional methods.

Figure 6:
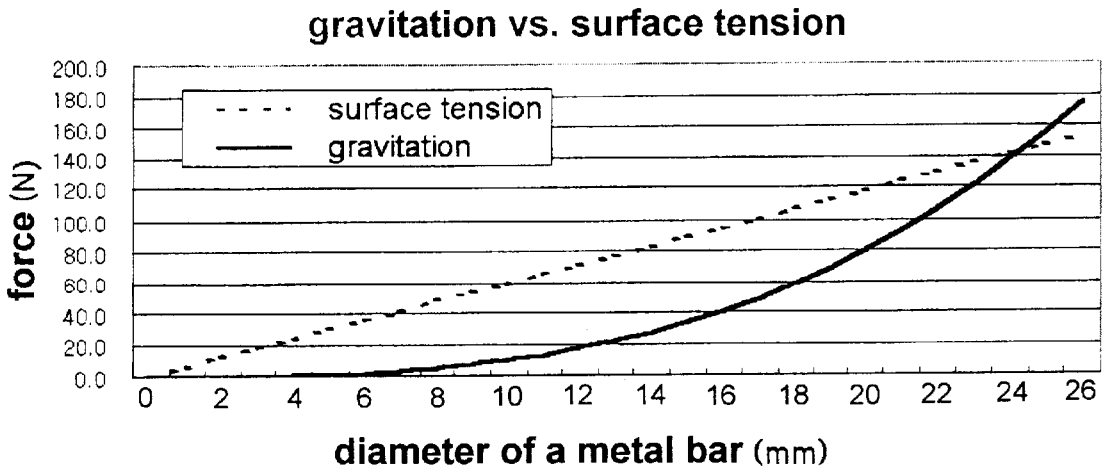
FIG. 6 is a graph illustrating a variation in the surface tension depending on a variation in the diameter of a metal bar, in order to estimate the size of the metal bar applicable to the present invention.

The most important parameter capable of allowing the molten metal to be maintained in a state depending from the end of the metal bar in the form of a droplet without falling is the diameter of the metal bar. FIG. 6 is a graph illustrating a variation in the surface tension depending on a variation in the diameter of the metal bar, in order to estimate the size of the metal bar applicable to the present invention. The optimum diameter of the metal bar can be estimated, based on a variation in the relation between the surface tension of the molten metal and the weight of the molten metal depending on a variation in the diameter of the metal bar. Based on the estimated result, the diameter of the metal bar is preferably 10 to 18 mm, and more preferably 12 to 14 mm. The number of metal bars to be simultaneously processed is preferably 10 to 20.

The metal material melted by the heating assembly 20 is solidified in the form of a metal filament by the cooling assembly 30. This cooling assembly 30 is illustrated in FIG. 4.

Figure 4:
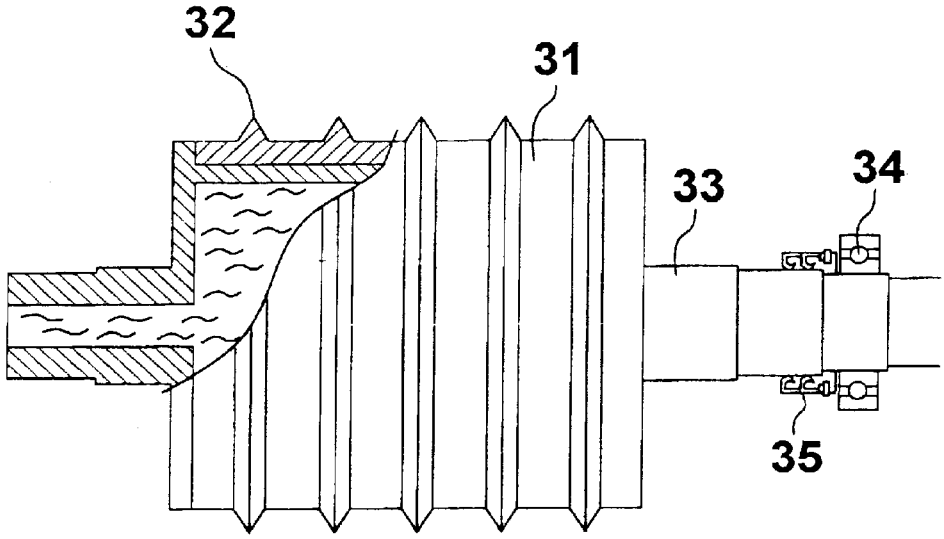
FIG. 4 is a partially-broken side view illustrating a metal bar cooling assembly according to the present invention in a separated state.

Referring to FIG. 4, the cooling assembly 30 includes a spinning disk 31 provided at a peripheral surface thereof with a plurality of disk blades 32 arranged at positions respectively corresponding to molten metal droplets depending from respective metal bars 1. Each disk blade 32 has a sharp edge. The spinning disk 31 serves to quench each molten metal at a rate of $10^4$ to $10^{6}$° C./sec while rotating at a linear speed of 1 to 100 m/sec, thereby spinning a metal filament. The cooling assembly 30 also includes a shaft 33 for supporting the spinning disk 31, a plurality of bearings 34 installed at desired areas in order to allow the shaft 33 to rotate smoothly, and a vacuum seal 35 adapted to maintain vacuum during the rotation of the shaft.

Cooling water adapted to cool the molten metal flows in the interior of the spinning disk 31. Although there is no limitation on the material of the spinning disk 31, a stainless steel or Cu alloy is preferably used for the spinning disk 31.

Figure 5:
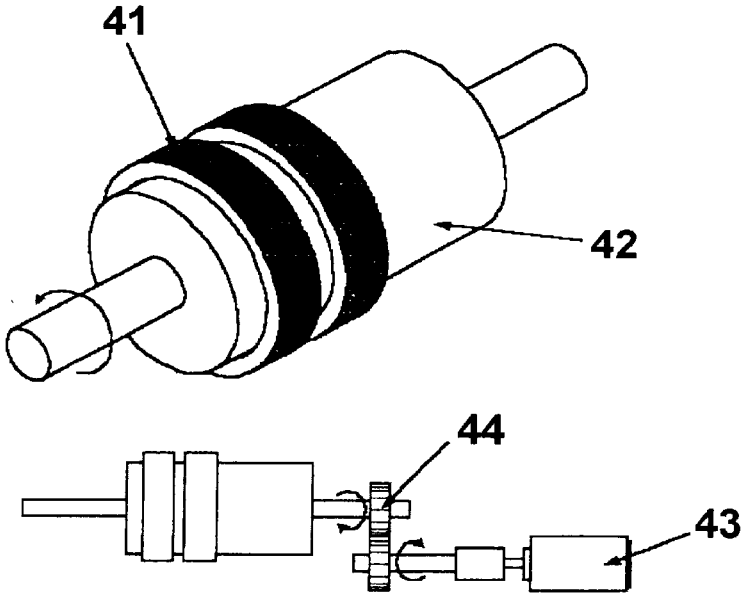
FIG. 5 includes a perspective view and a schematic view illustrating a metal bar wiping assembly according to the present invention in a separated state.

FIG. 5 includes a perspective view and a schematic view illustrating the wiping assembly for metal bars in a separated state. As shown in FIG. 5, the wiping assembly 40 includes a heat-resistant non-woven fabric 41 adapted to come into direct contact with the spinning disk 31, a rotating drum 42 adapted to support the non-woven fabric 41 while enabling a continuous cleaning operation while reducing generation of friction, and a rotating motor 43 and a rotating gear 44 for rotating the drum 42. An organic material is coated over the surface of the non-woven fabric 41. The organic material is selected from the group consisting of lithium soap, silicon, and hydrocarbon-based materials. The hydrocarbon-based materials include pentaphenyl-trimethyl trisiloxane, chlorofluorocarbon, and perfluorinated polyeter.

The wiping assembly 40 is of a rotating type. This wiping assembly 40 is arranged beneath the spinning disk 31 and adapted to remove residual materials or foreign matters firmly attached to the spinning disk 31, thereby allowing a continuous extraction of metal filaments. When the molten metal of high temperature is quenched on the spinning disk of low temperature, it may be left on the spinning disk due to its residual stress and chemical affinity without being released from the rotating disk. When such a residual material subsequently comes into contact with or strikes a molten metal droplet freely depending from the metal bar end, it destroys the stability of the molten metal. In this case, the manufacturing process is ceased. Such a problem can be solved by the wiping assembly 40 of the present invention. The circular shape of the wiping assembly 40 and the material coated over the wiping assembly 40 make it possible to maintain the edge shape-of each disk blade 32 even after a prolonged time of use, and to allow quenched metal filaments to be easily released from the spinning disk 31.

Now, a method for manufacturing metal filaments using the apparatus of the present invention will be described. In accordance with this method, air is first vented from the chamber 50 in which the metal bar heating assembly 20, cooling assembly 30, and wiping assembly 40 are installed. In accordance with the air ventilation, the chamber 50 is maintained in a high vacuum state. A plurality of metal bars 1 are supplied at a speed of 0.1 to 100 mm/min using the metal bar supply assembly 10 so that the end of each metal bar 1 is arranged near the induction coil 21 of the metal bar heating assembly 20. Thereafter, electric power is applied to the induction coil 21, thereby locally heating and melting the tip of each metal bar 1. Thus, molten metal is hung in the form of a droplet maintained in a state depending from the end of the metal bar 1 without using any vessel. The molten metal is brought into contact with the associated disk blade 32 of the spinning disk 31 rotating at a linear speed of 1 to 100 m/sec, so that it is soared up in the form of a metal filament having a diameter of 10 to 150 $\mu$m while being quenched at a rate of $10^4$ to $10^{6°}$ C./sec. The soaring of metal filaments means that metal filaments are discharged while flying along a parabolic orbit. Each disk blade 32 of the spinning disk 31 is then brought into contact with the non-woven fabric 41 attached to the rotating drum 42 of the wiping assembly, so that residual materials or. foreign matters firmly attached to the disk blade 32 are removed. Thus, a continuous extraction of metal filaments is achieved.

The metal filaments manufactured in accordance with the present invention and made of, in particular, Fe, Cr, or Al alloy exhibit a superior heat resistance even at a high temperature of 1,000° C. Accordingly, the metal filaments can be applied to porous mats for surface combustion installed in combustion parts of dust collecting systems in incinerators, boilers, and burners, and filters for decomposition of noxious gas generated at vehicles.

The metal filaments of the present invention may also be applied to filters for purification of gas, purification of water, and decomposition of noxious materials. Such filters made of fibers exhibit superior filtering characteristics because they have a very high porosity, as compared to compact or mesh type filters. The filters made of the filaments according to the present invention can be widely used in organic chemical processes such as polymer filtering processes, and for products adapted to filter high-temperature liquids having a high back pressure. The metal filaments manufactured in accordance with the present invention can be used to fabricate fibers exhibiting a superior heat resistance and a superior corrosion resistance in accordance with the composition and characteristics of the used metal bar. Where a metal material having a superior magnetic property and conductivity is used, the metal filament of the present invention can also be used for electromagnetic shields.

Hereinafter, the present invention will be described in conjunction with an example. This example is made only for illustrative purposes, and the present invention is not to be construed as being limited to the example.

EXAMPLE

Manufacture of Alloy Fibers (Fecralloy®) Containing Fe, Cr, and Al

The metal filament manufacturing apparatus of the present invention was prepared. A vacuum was then formed in the interior of the metal filament manufacturing apparatus. Subsequently, 10 metal bars having a diameter of 13.7 mm were fixed to the support member 11. As electric power was applied to the spiral induction coil, each metal bar was melted by induced current generated in accordance with the application of the electric power. The molten metal was maintained in a state freely depending from the end of the metal bar in accordance with the balance between the weight of the molten metal and the surface tension of the molten metal without using any vessel. The metal bar was downwardly fed, thereby causing the molten metal depending from the metal bar to come into contact with the spinning disk 31 made of stainless steel. The molten metal contacting each disk blade 32 was continuously soared up in the form of a continuous metal filament (Fecralloy®) while being independently and finely controlled in accordance with vertical movements of the metal bar supply assembly. The metal filaments were soared up without coming into contact with the induction coil because the induction coil has a shape bent in the form of a nose. Materials left on each disk blade 32 were released from the disk blade 32 by the non-woven fabric coated with pentaphenyl-trimethyl trisiloxane and rotated by the rotating drum. Thus, metal filaments were continuously manufactured without any process ceasing.

As apparent from the above description, in accordance with the metal filament manufacturing apparatus and method, it is possible to manufacture, at a high cooling rate, metal filaments having an ingredient uniformity equivalent to that of metals of liquid phase. In accordance with the present invention, it is possible to obtain fibers even in the case of intermetallic compounds and super stainless steel. In accordance with the present invention, fibers are obtained from molten metal maintained in a state freely depending from metal bars without any separate vessel under the condition in which the metal bars are independently moved. Accordingly, a high process stability and a high efficiency are achieved. A large quantity of metal filaments having superior characteristics can be manufactured by performing the manufacturing process one time.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for manufacturing metal filaments comprising:

metal bar supply assembly including a support member adapted to support a plurality of metal bars, a screw adapted to rotate for a vertical movement thereof by a servo-motor, and a guide rod adapted to guide the screw to carry out an accurate vertical movement, the support member connecting the metal bars, the screw, and the guide rod, and vertically feeding the metal bars at a speed of 0.1 to 100 mm/min, the metal bar supply assembly being configured to individually control the metal bars;

metal bar heating assembly including an induction coil arranged near the tip of the metal bars, and adapted to melt a limited part of the metal bars in accordance with a heating operation thereof, a coil block adapted to supply high frequency induction current to heat each of the metal bars to a melting temperature, and a coil cooling water supplier adapted to prevent the induction coil from being melted, the induction coil being upwardly bent in the form of a nose shape at regions thereof where metal filaments are discharged while being soared up, respectively, so as to prevent the molten metal of each of the metal bars from being affected by the induction coil during soaring of the metal filaments;

cooling assembly including a spinning disk provided at a peripheral surface thereof with a plurality of disk blades each having a sharp edge, the spinning disk serving to quench the molten metal at a rate of $10^4$ to $10^{6°}$ C./sec while rotating at a linear speed of 1 to 100 m/sec, thereby spinning a metal filament; and wiping assembly including a heat-resistant non-woven fabric adapted to come into direct contact with the spinning disk, thereby removing residual metal materials left on the spinning disk without being released from the spinning disk during the soaring of the metal filaments, and a rotating drum adapted to support the non-woven fabric while enabling a continuous cleaning operation and reducing generation of friction;

wherein the metal bar heating assembly, the cooling assembly, and the wiping assembly are arranged in the interior of a vacuum chamber, the molten metal is hung in the form of a droplet depending from its metal bar by its surface tension without using any particular vessel, and the soaring metal filaments have a diameter of 10 to 150 $\mu$m.

2. The apparatus according to claim 1, wherein the non-woven fabric of the wiping assembly is coated with an organic material selected from a group consisting of lithium soap, silicon, and hydrocarbon-based materials.

3. A method for manufacturing metal filaments comprising the steps of:

preparing a metal filament manufacturing apparatus according to claim 1, the apparatus including metal bar supply assembly for supporting a plurality of metal bars, and vertically feeding the metal bars, metal bar heating assembly including an induction coil, a coil block, and a coil cooling water supplier, cooling assembly including a spinning disk provided at a peripheral surface thereof with a plurality of disk blades each having a sharp edge, and wiping assembly including a heat-resistant non-woven fabric, and a rotating drum;

forming a vacuum in a chamber in which the metal bar heating assembly, the cooling assembly, and the wiping assembly are arranged;

supplying a plurality of metal bars at a speed of 0.1 to 100 mm/min by the metal bar supply assembly, thereby arranging the end of each of the metal bars near the induction coil of the metal bar heating assembly, applying electric power to the induction coil, thereby heating a limited part and melting the tip of the metal bar, so that molten metal is freely hung at the end of the metal bar in the form of a droplet maintained in a state depending from the end of the metal bar without using any vessel;

bringing the molten metal into contact with an associated one of the disk blades of the spinning disk rotating at a linear speed of 1 to 100 m/sec, thereby spinning the molten metal in the form of a metal filament having a diameter of 10 to 150 $\mu$m while quenching the molten metal at a rate of $10^4$ to $10^{6°}$ C./sec; and bringing the disk blades of the spinning disk brought into contact with the non-woven fabric attached to the rotating drum of the wiping assembly, thereby removing residual materials or foreign matters firmly attached to the disk blade.

4. The method according to claim 3, wherein the metal bars have a diameter of 10 to 18 mm, and the number of the metal bars is 10 to 20.

5. The method according to claim 3, wherein the chamber is in a vacuum of $10^{-1}$ to $10^{-7}$ torr.

6. The method according to claim 3, wherein the non-woven fabric of the wiping assembly is coated with an organic material selected from a group consisting of lithium soap, silicon, and hydrocarbon-based materials.

* * * * *